US005321943A

United States Patent [19]

Schmid et al.

[11] Patent Number: 5,321,943

[45] Date of Patent: Jun. 21, 1994

[54] YARN WITHDRAWAL NOZZLE FOR OPEN-END SPINNING ARRANGEMENTS

[75] Inventors: Friedbert Schmid, Bad Überkingen; Günter Tromer, Reichenbach, both of Fed. Rep. of Germany

[73] Assignee: Spindelfabrik Suessen, Schurr, Stahlecker & Grill GmbH, Fed. Rep. of Germany

[21] Appl. No.: 897,769

[22] Filed: Jun. 12, 1992

[30] Foreign Application Priority Data

Jun. 12, 1991 [DE] Fed. Rep. of Germany ..... 4119264

[51] Int. Cl.[5] ..... D01H 4/40; D01H 4/08

[52] U.S. Cl. ..... 57/417

[58] Field of Search ..... 57/417

[56] References Cited

U.S. PATENT DOCUMENTS

| | | | |
|---|---|---|---|
| 3,640,061 | 2/1972 | Landwehrkamp | 57/244 |
| 3,965,661 | 6/1976 | Yoshida | 57/417 |
| 4,385,488 | 5/1983 | Raasch et al. | 57/417 |
| 4,773,211 | 9/1988 | Stahlecker et al. | 57/417 |
| 4,791,781 | 12/1988 | Phoa et al. | 57/417 |

FOREIGN PATENT DOCUMENTS

| | | | |
|---|---|---|---|
| 445554 | 9/1991 | European Pat. Off. | 57/417 |
| 2410940 | 1/1978 | Fed. Rep. of Germany . | |
| 3016675 | 5/1981 | Fed. Rep. of Germany . | |
| 3419300 | 11/1985 | Fed. Rep. of Germany . | |
| 62-250237 | 10/1987 | Japan | 57/417 |
| 1568070 | 10/1976 | United Kingdom . | |
| 2075071 | 11/1981 | United Kingdom | 57/417 |

*Primary Examiner*—Daniel P. Stodola
*Assistant Examiner*—William Stryjewski

[57] ABSTRACT

A yarn withdrawal nozzle is provided for an open-end spinning arrangement, the essentially funnel-shaped contact surface of which consists of a material which, in a temperature range of approximately 50° C. to approximately 100° C., has a thermal conductivity of at least 80 W/mK (Watts per meter Kelvin) so that as a result damage to synthetic fibers caused by overheating is avoided also in the case of relatively high rotational rotor speeds.

18 Claims, 1 Drawing Sheet

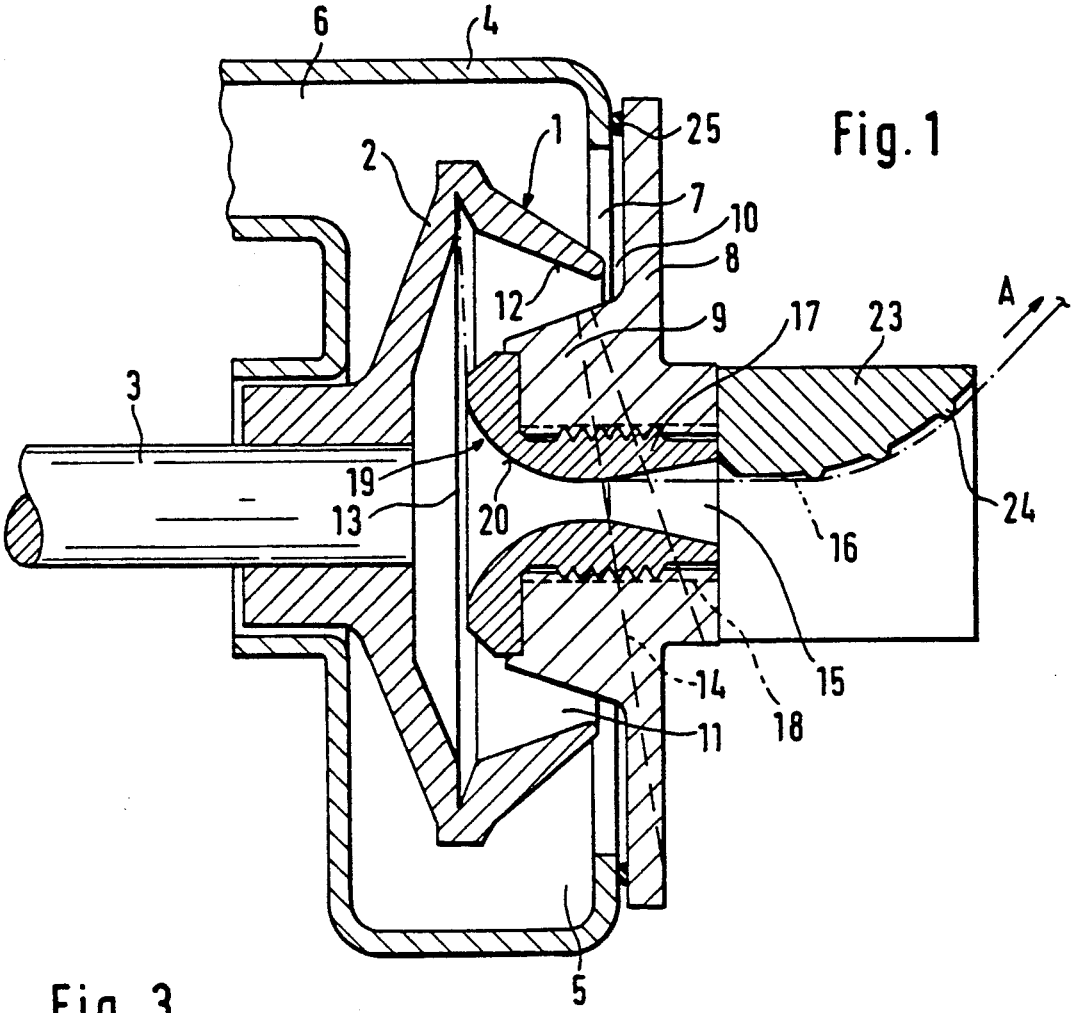
Fig. 1
Fig. 3
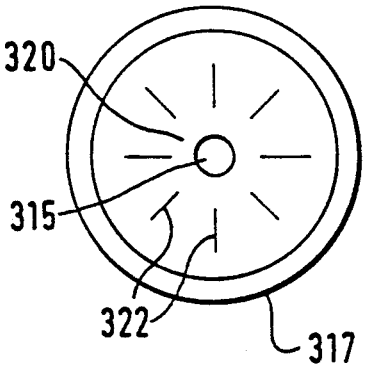
Fig. 2
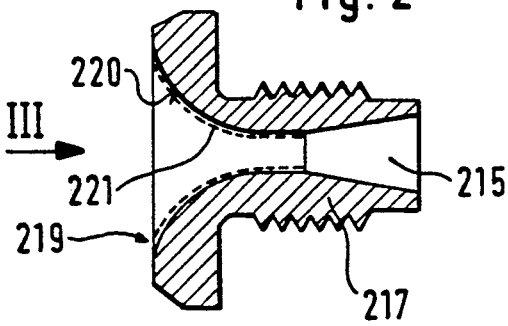

YARN WITHDRAWAL NOZZLE FOR OPEN-END SPINNING ARRANGEMENTS

BACKGROUND AND SUMMARY OF THE INVENTION

This invention relates to a yarn withdrawal nozzle for open-end spinning arrangements which has an essentially funnel-shaped contact surface serving as the deflecting guide for a spun yarn.

In the case of open-end rotor spinning machines, for example, in the case of the rotor spinning machine sold by the firm W. Schlafhorst AG & Co., Mönchengladbach, under the tradename of "Autocoro", yarn withdrawal nozzles are used which consist of a ceramic material on an aluminum oxide base. Such yarn withdrawal nozzles made of ceramics withstand the high wearing stress which occurs in the case of such open-end rotor spinning machines which currently are operated at rotational speeds of the spinning rotors of up to 130,000 $min^{-1}$. However, when synthetic fibers, particularly polyester fibers or mixtures of natural fibers and synthetic fibers are processed, the operating speeds of such open-end rotor spinning machines are limited. The open-end rotor spinning machines cannot be operated at the possible high rotational speeds because damage by overheating caused by frictional heat occurs at the synthetic fibers. It is therefore customary to operate the open-end rotor spinning machines at a reduced speed, that is not at the maximally possible rotational rotor speed, when synthetic fibers are to be processed. In comparison to the theoretically possible rotational rotor speeds, this represents a production loss because the production of an open-end rotor spinning machine is directly proportional to the rotational rotor speed. This problem of damage to synthetic fibers or chemical fibers has been known for a long time and a satisfactory solution has not been found in this respect. It is known, for example, (German Patent Document DE 24 10 940 C3) to direct a cooling air flow onto a yarn guiding funnel which corresponds to a yarn withdrawal nozzle with respect to its function. However, this has not led to a useful solution.

It is an object of the invention to provide the prerequisites for enabling the open-end rotor spinning arrangements to run at an increased speed and particularly at increased rotational rotor speeds and, in the process, to be able to also spin synthetic fibers or chemical fibers without any damage to them.

This object is achieved according to preferred embodiments of the invention by providing that at least the contact surface of the yarn withdrawal nozzle consists of a material which has a thermal conductivity of at least 80 W/mK (Watts per meter Kelvin) in a temperature range of approximately 50° C. to approximately 100° C.

A damaging of the fibers can only be avoided if the generated frictional heat between the fibers and the contact surface of the yarn withdrawal nozzle does not result in an unacceptably high temperature of the fibers. The invention is therefore based on the consideration that the generating of the frictional heat itself, which is a function of the coefficient of friction, of the normal force between the yarn and the contact surface of the withdrawal nozzle and of the sliding speed, cannot be reduced significantly for reasons of spinning technology. It is therefore provided that the yarn withdrawal nozzle will be capable of dissipating the frictional heat sufficiently and also as fast as possible so that the undissipated portion of the frictional heat does not result in an exceeding of a critical temperature for the fibers and thus to a local overheating of these fibers. In this case, the invention is also based on the recognition that it is not the withdrawal speed of the yarn that is the main cause of the previous fiber damage but rather the fact that the spun yarn rotates along at approximately the rotational speed of the rotor in the manner of a crank and in the process slides essentially on the contact surface of the yarn withdrawal nozzle. The contact point of the yarn on the contact surface therefore changes constantly so that an effective dissipation of frictional heat on it is always possible.

This solution according to the invention differs clearly from the known solution (German Patent Document DE 24 10 940 C3), specifically of cooling by means of an air flow, the yarn guiding funnel, which can be compared with a yarn withdrawal nozzle. Such an air cooling cannot prevent the local overheating of the fibers because of the generated frictional heat because it is not effective at the point at which the frictional heat is generated, specifically between the contact surface and the corresponding fibers. The cooling of such an air flow therefore always comes too late because it only becomes effective after the frictional heat has already caused the increased temperature in the fibers. The resulting damage can no longer be reversed.

Tests carried out by and in behalf of applicants have shown that, for example, by means of yarn withdrawal nozzles made of copper which has a very high thermal conductivity, it is possible to increase the rotational rotor speeds and thus the spinning speed without any damage to the fibers by at least 20% compared to the previously possible rotational rotor speeds.

In a further development of the invention, a basic body is provided for the yarn withdrawal nozzle which is coated with the material at least in the area of the contact surface. Since in every case only a short-term but fast heat dissipation is required, it is to be expected that also a relatively thin coating of less than 0.5 mm will be sufficient for obtaining the desired effect.

In a further development of the invention, it is provided that the contact surface has a hardness of at least 20 $HV_{5N}$. Thus it is ensured that a sufficiently high resistance to wear exists so that such a yarn withdrawal nozzle also has a sufficient useful life.

In a further development of the invention, it is provided that the material is titanium diboride. This material has the two characteristics which are the most desirable, specifically a high heat conductivity in a temperature range of approximately 50° to approximately 100° C., while it also has a high hardness.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial sectional view of an open-end spinning arrangement in the area of a spinning rotor and of a yarn withdrawal nozzle, constructed according to a preferred embodiment of the present invention;

FIG. 2 is a sectional view of another embodiment of a yarn withdrawal nozzle constructed according to the present invention; and FIG. 3 is a view in the direction of the Arrow III of the withdrawal nozzle of FIG. 2 or of FIG. 1, depicting further preferred embodiments of the invention.

DETAILED DESCRIPTION OF THE DRAWINGS

The open-end spinning arrangement which is only partially shown in FIG. 1, comprises a spinning rotor assembly 1 which, in the known manner, is composed of a rotor or rotor plate 2 and a shaft 3, which shaft is non-rotatably connected with this rotor 2. The shaft 3 is disposed in a manner not shown in detail and is driven to high rotational rotor speeds. These rotational speeds currently reach 130,000 $min^{-1}$ (revolutions per minute). The rotor 2 is arranged in a rotor housing 4 which forms a vacuum chamber 5 surrounding the rotor 2 and, by way of a vacuum pipe 6, is connected with a vacuum source which is not shown. On the open side of the rotor 2, which faces away from the shaft 3, the rotor housing 4 is provided with an opening which is larger than the outside diameter of the rotor 2 so that this rotor can be pulled out of the rotor housing 4 toward the front and operating side.

In the operating condition, the opening 7 of the rotor housing 4 is closed by means of a covering 8 which is placed against the rotor housing 4 with the insertion of a sealing device 25. The covering 8 is provided with a projection 9 which projects into the open front side 11 of the rotor 2 and leaves a gap 10 through which the air can flow off which transports the fibers into the rotor 2. In the covering 8, a fiber feeding duct 14 is provided which leads into the projection 9 inside the rotor 2. The fiber feeding duct 14 starts at an opening roller which is not shown and which opens up a fed fiber material into individual fibers. By way of the vacuum pipe 6, a transport air flow is generated into the fiber feeding duct 14 which flows off through the gap 10. The fibers which are carried along, on the other hand, reach a sliding wall 12 of the rotor 2 which opens up conically to a fiber collecting groove 13. The fibers slide on the sliding wall to the fiber collecting groove 13.

The fibers collected in the fiber collecting groove are withdrawn during the normal spinning operation from the fiber collecting groove as a spun yarn which is indicated by a dash-dotted line. In this case, the spun yarn 16 is first withdrawn essentially in the radial plane of the fiber collecting groove and is then deflected in the axial direction coaxially with respect to the rotor by way of a yarn withdrawal nozzle 17. The yarn 16 then travels over a twist stopping device 23 which is provided with false-twisting ribs 24 and in the area of which it is deflected into the direction of the arrow (A), after which it travels to a withdrawal device which is not shown. The yarn withdrawal device is followed by a wind-up device, which is not shown, and by means of which the spun yarn is wound into a package. The withdrawal nozzle 19 has a funnel-shaped inlet 19 which starts in the area of the collecting groove 13 and which has a curved contact surface 20 which changes into a section 15 extending coaxially with respect to the rotor shaft 3 and which widens in the shape of a slight truncated cone in the direction of the twist stopping element 23. The yarn withdrawal nozzle 17 is provided with an external thread by means of which it is screwed into a threaded bore 18 of the covering 8.

During the spinning operation, the portion of the spun yarn 16 extending from the contact surface 20 to the fiber collecting groove of the rotor 2 rotates in a crank-type manner. The rotating movement is lower than the circumferential speed of the fiber withdrawal groove 13 by the yarn withdrawal speed. This yarn portion, which rotates in the manner of a crank, has the result that the yarn 16 slides predominantly on the contact surface, in which case, however, a slight false twist is introduced which is superposed on the true twist generated by the rotating of the rotor. This sliding movement of the yarn 16 on the contact surface 20 of the yarn withdrawal nozzle 17, which takes place in the circumferential direction, is the main reason for the generating of frictional heat. The yarn withdrawal speed which is much lower plays only a subordinate role with respect to the generating of frictional heat. Up to now, this frictional heat, in the case of very high rotational rotor speeds, had the result that chemical fibers, such as polyester fibers, were damaged mechanically and/or thermally because of local overheating. In order to avoid or at least reduce these damages despite high rotational rotor speeds, and thus permit higher rotational rotor speeds than previously, the yarn withdrawal nozzle 17 is made of a material which, on the one hand, has a high resistance to wear and, on the other hand, has a high thermal conductivity; that is, in a temperature range of approximately 50° C. to approximately 100° C., a thermal conductivity of at least 80 W/mK (Watts per meter Kelvin). This high thermal conductivity determines essentially the heat penetration number which is the square root of the density, the heat conductivity and the specific heat. This high thermal conductivity, which causes a correspondingly high heat penetration number, has the result that a considerable portion of the resulting frictional heat is immediately dissipated by means of the withdrawal nozzle 17 at the point where it is generated so that this frictional heat does not have the result that the chemical fibers or synthetic fibers are heated to unacceptably high temperatures. Since the frictional heat is in each case generated only in a locally limited manner at the point at which the yarn 16 happens to be situated during the crank-shaped rotation, the yarn withdrawal nozzle as a whole is not heated to excessively high values. Normally, the yarn withdrawal nozzle 17 assumes values of 50° C. to 100° C. Since the yarn withdrawal nozzle 17 is situated in the metallic covering 8, the heat is dissipated further.

In order to ensure a sufficiently long useful life, the contact surface 20 of the yarn withdrawal nozzle 17 must also have a sufficiently high hardness; that is, a hardness of at least 20 $VH_{5N}$ (Vickers Hardness at 5N Load). It was found that a material with a suitable thermal conductivity and a suitable hardness is available in the case of titanium diboride which has a heat conductivity of 210 W/mK and a hardness of 28 $VH_{5N}$. This titanium boride can be manufactured in powder form and can be processed as a ceramic material.

While, in the case of the embodiment according to FIG. 1, the whole yarn withdrawal nozzle 17 is made of a suitable material, the yarn withdrawal nozzle 217 according to FIG. 2 is provided only in the area of the contact surface 220 of the inlet funnel 219 with a coating 221, indicated by an interrupted line, of this material which has a high conductivity and a high hardness. In this case, titanium diboride may, for example, be applied as a plasma coating. Since the frictional heat, in each case, occurs only locally and only for a short time, it is to be expected that a relatively thin coating 221 of 0.5 mm and less will be sufficient. Expediently, this coating is applied to a basic body made of metal so that, on the whole, the generated heat can be transmitted. In this case, particularly copper can be used which has a higher thermal conductivity, specifically 384 W/mK, than the coating material titanium diboride.

In the case of the embodiment according to FIG. 3, it is also provided that, in the area of the inlet funnel 219, the contact surface 320 is provided with grooves or notches 322, as known on the basis of the state of the art. These notches 322 or grooves, which extend into the area of the axial duct 315, increase the spinning stability in a known manner. It is also contemplated to provide corresponding notches in the embodiment according to FIG. 1.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A yarn withdrawal nozzle for open-end spinning arrangements which has an essentially funnel-shaped contact surface serving as a deflecting guide for a spun yarn, wherein at least the contact surface consists of a material which has a thermal conductivity of at least 80 W/mK (Watts per meter Kelven) in a temperature range of approximately 50° C. to approximately 100° C. to transfer heat generated by yarn friction through said material so as to cool the nozzle.

2. A yarn withdrawal nozzle according to claim 1, wherein the withdrawal nozzle includes a basic body which is coated with the material at least in the area of the contact surface.

3. A yarn withdrawal nozzle according to claim 2, wherein the basic body is a metallic basic body having a thermal conductivity which is larger than the thermal conductivity of the material applied as the coating in the temperature range of approximately 50° C. to approximately 100° C.

4. A yarn withdrawal nozzle according to claim 3, wherein the basic body is made of copper or a copper alloy.

5. A yarn withdrawal nozzle according to claim 4, wherein the material is titanium diboride.

6. A yarn withdrawal nozzle according to claim 3, wherein the material is titanium diboride.

7. A yarn withdrawal nozzle according to claim 2, wherein the basis body is made of copper or a copper alloy.

8. A yarn withdrawal nozzle according to claim 7, wherein the material is a plasma coating on the basic body.

9. A yarn withdrawal nozzle according to claim 2, wherein the material is a plasma coating on the basic body.

10. A yarn withdrawal nozzle according to claim 1, wherein the entire yarn withdrawal nozzle is made of the material.

11. A yarn withdrawal nozzle according to claim 1, wherein the contact surface has a hardness of at least 20 $VH_{5N}$ (Vickers Hardness at 5N Load).

12. A yarn withdrawal nozzle according to claim 1, wherein the material is titanium diboride.

13. A yarn withdrawal nozzle according to claim 12, wherein the material is a plasma coating on the basic body.

14. A method of making a yarn withdrawal nozzle for open-end spinning arrangements which has an essentially funnel-shaped contact surface serving as a deflecting guide for a spun yarn, said method comprising:

forming a yarn withdrawal nozzle basic body, and providing the basic body with a contact surface area consisting of a material which has a thermal conductivity of at least 80 W/mK (Watts per meter Kelvin) in a temperature range of approximately 50° C. to 100° C. to transfer heat generated by yarn friction through said material so as to cool the nozzle.

15. A method according to claim 14, wherein said basic body is formed of one of copper and a copper alloy, and wherein said providing with a material includes coating said material on the basic body contact surface.

16. A method according to claim 14, wherein said providing a material includes plasma coating the material on he basic body.

17. A yarn withdrawal nozzle according to claim 16, wherein the step of forming the basic body includes forming the basic body from copper or a copper alloy.

18. A yarn withdrawal nozzle according to claim 16, wherein the step of providing the basic body in its contact surface area with a material includes the step of providing titanium diboride as the material.

* * * * *